US005379612A

United States Patent [19]

Stoll et al.

[11] Patent Number: 5,379,612

[45] Date of Patent: Jan. 10, 1995

[54] METHOD OF PRODUCING VOLUMINOUS KNITTED ARTICLES

[75] Inventors: Thomas Stoll, Reutlingen; Wolfgang Rempp, Sonnenbühl; Franz Schmid, Bodelshausen, all of Germany

[73] Assignee: H. Stoll GmbH & Co., Reutlingen, Germany

[21] Appl. No.: 75,771

[22] Filed: Jun. 11, 1993

[30] Foreign Application Priority Data

Jun. 25, 1992 [DE] Germany ..... 4220861

[51] Int. Cl.[6] ..... D04B 7/30; D04B 1/22

[52] U.S. Cl. ..... 66/64; 66/180; 66/196

[58] Field of Search ..... 66/69, 70, 71, 72, 73, 66/75.1, 194, 196, 190, 180, 183, 188, 173, 64

[56] References Cited

U.S. PATENT DOCUMENTS 2,703,971 3/1955 Bausher ..... 66/180 X
3,307,379 3/1967 Woolley et al. ..... 66/196 X

FOREIGN PATENT DOCUMENTS 7122633 6/1971 Germany .
9017482 8/1991 Germany .

*Primary Examiner*—Clifford D. Crowder
*Assistant Examiner*—John J. Calvert
*Attorney, Agent, or Firm*—Michael J. Striker

[57] ABSTRACT

A method of knitting a multi-dimensional fabric for use in upholstery is accomplished by simultaneously knitting rib and jersey wales. The resultant fabric creates a layered or convex pocket appearance similar to that of pleated fabric formed by sewing. The method uses movement of the rib forming carriage to form pockets that are connected by the jersey stitches on the rear face and rib stitches on the face of the fabric.

5 Claims, 5 Drawing Sheets

METHOD OF PRODUCING VOLUMINOUS KNITTED ARTICLES

BACKGROUND OF THE INVENTION

The present invention relates to a method of producing voluminous knitted articles, especially for upholstering, on a two-bed flat knitting machine.

During use of knitted articles for technical purposes in which the high stretching ability and elastic deformation ability of knitted articles when compared with woven articles are important, there is a requirement to more or less tightly fill hollow spaces with the knitted article or to provide upholstery coating.

SUMMARY OF THE INVENTION

Accordingly, it is an object of the present invention to provide a method of producing voluminous knitted articles which have a suitable shape and are easy to manufacture.

In keeping with these objects and with others which will become apparent hereinafter, one feature of the present invention resides, briefly stated, in a method of producing knitted articles, in accordance with which pocket-shaped convexities from a base plane are knitted over the length of the knitted article progressively and thereby one after the other.

In accordance with an advantageous feature of the present invention, it is desirable to form such a voluminous knitted article during the knitting process so that it has a predetermined shape fixation in form of quilted (closing) seams.

Advantageously, in accordance with a further feature of the present invention, for forming the pockets starting from a first edge the maximal knitting width of the knitted article is knitted over a smaller base knitting width, and the base knitting width is offset from wale to wale to a side, until the second edge of the maximal knitting width is obtained. Then the knitting is performed in another direction with a corresponding offset until again the first edge of the maximal knitting width is obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
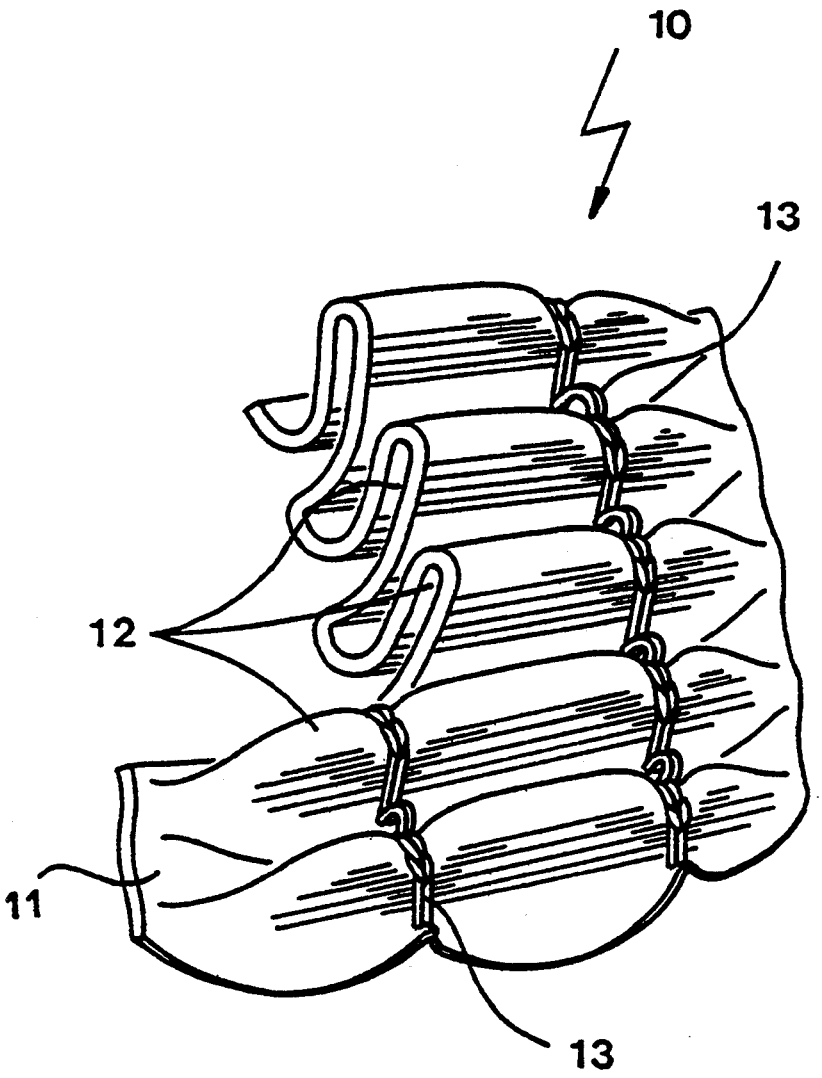
FIG. 1 is a perspective view of a voluminous knitted article produced in accordance with the present invention, with shape-fixing additional stitch wales.

FIG. 1 shows a part of a voluminous knitted web 10. The knitted web 10 is formed so that pocket-shaped convexities 12 are knitted from a knitting base plane 11 successively after one another. For stabilizing the shape of the knitted article, stitch wales 13 can be worked in during the knitting process. They pull together the voluminous knitted web 10 similarly to the stitch seams in direction to the knitting base plane 11.

Figure 2:
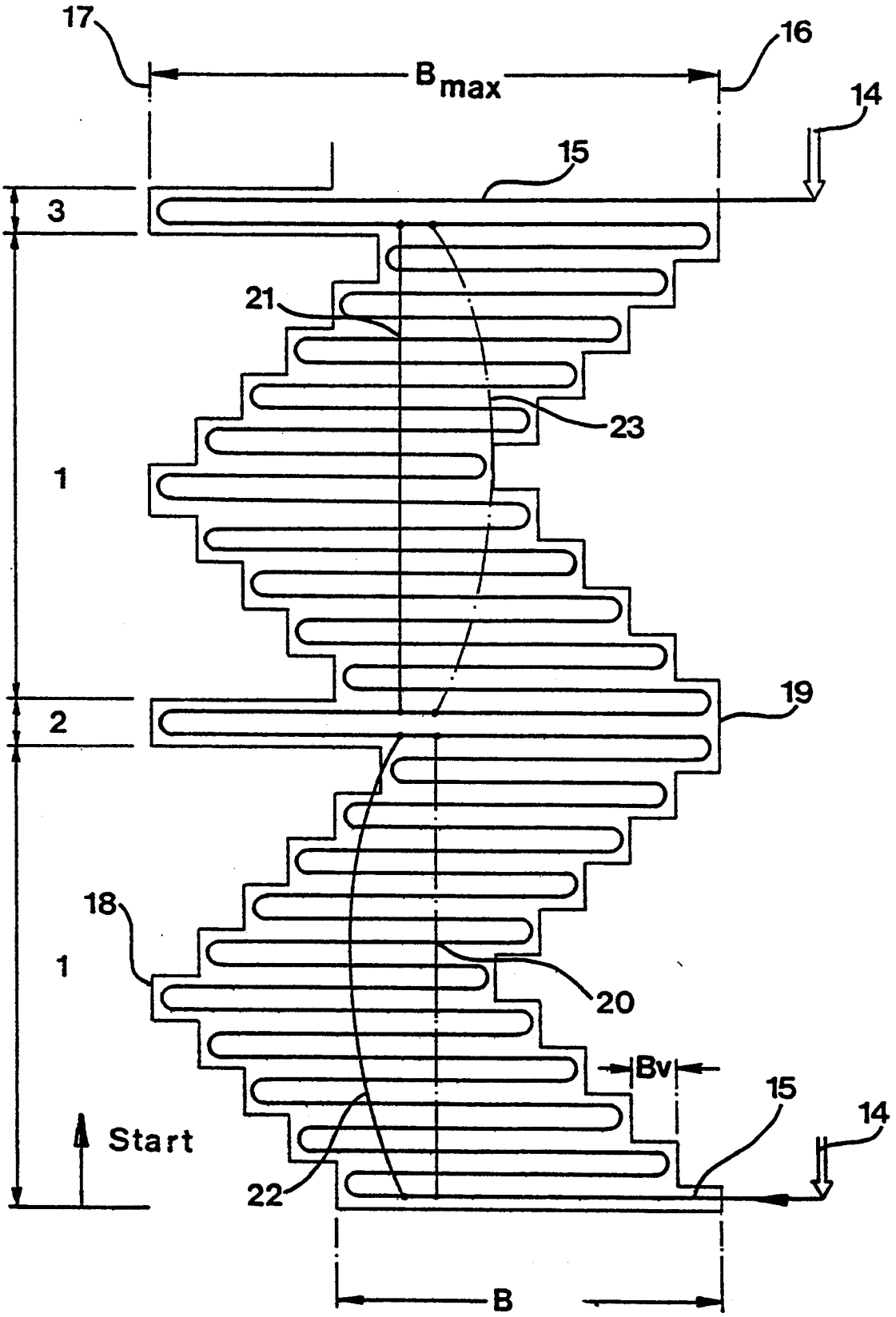
FIG. 2 is a view schematically showing the movement of a thread guide through four successive knitting regions, from which also an offset movement of needle bed during a pocket formation can be seen.

FIG. 2 shows the movement of a thread guide 14 during the production of the voluminous knitted article through four successive knitting regions which are identified with reference numerals 1, 2 and 3 in correspondence with the features of the knitting formation. The maximal knitting width is identified in FIG. 2 as Bmax. One edge of the maximal knitting width is identified as 16 and the another left edge is identified as 17. In the beginning of the production of the knitted article, first a knitting region 1 is produced. In this region for forming a pocket 12 with the thread 15 supplied from the thread guide 14 from one edge 16 the maximal knitting width Bmax is knitted over a base knitting width Bgrund. This base knitting width Bgrund is offset from one wale to another wale to one side, in FIG. 2 to the left, until at the point 18 the second edge 17 of the maximal knitting width Bmax is obtained. Then the knitting continues in another direction with a corresponding offset, until at the point 19 the first edge 16 of the maximal knitting width Bmax is obtained. In a subsequent knitting region 2 the knitting is then performed over the whole maximal knitting width Bmax. Then again the formation of a knitting region 1 begins, which is followed then by a knitting region 2 in which again the knitting is performed over the whole maximum knitting width.

A straight line 20 or 21 and a curved line 22 or 23 are applied in both knitting regions 1 of FIG. 2. The solid lines 21 and 22 symbolize a thread extending on the front side of the knitted article, while the dash-dot lines 20 and 23 symbolize a thread on the rear side of the knitted article, which together form a stitch wale 13. The curved lines symbolize a floating thread while the solid lines symbolize a thread which is knitted to the wale.

Figure 3:
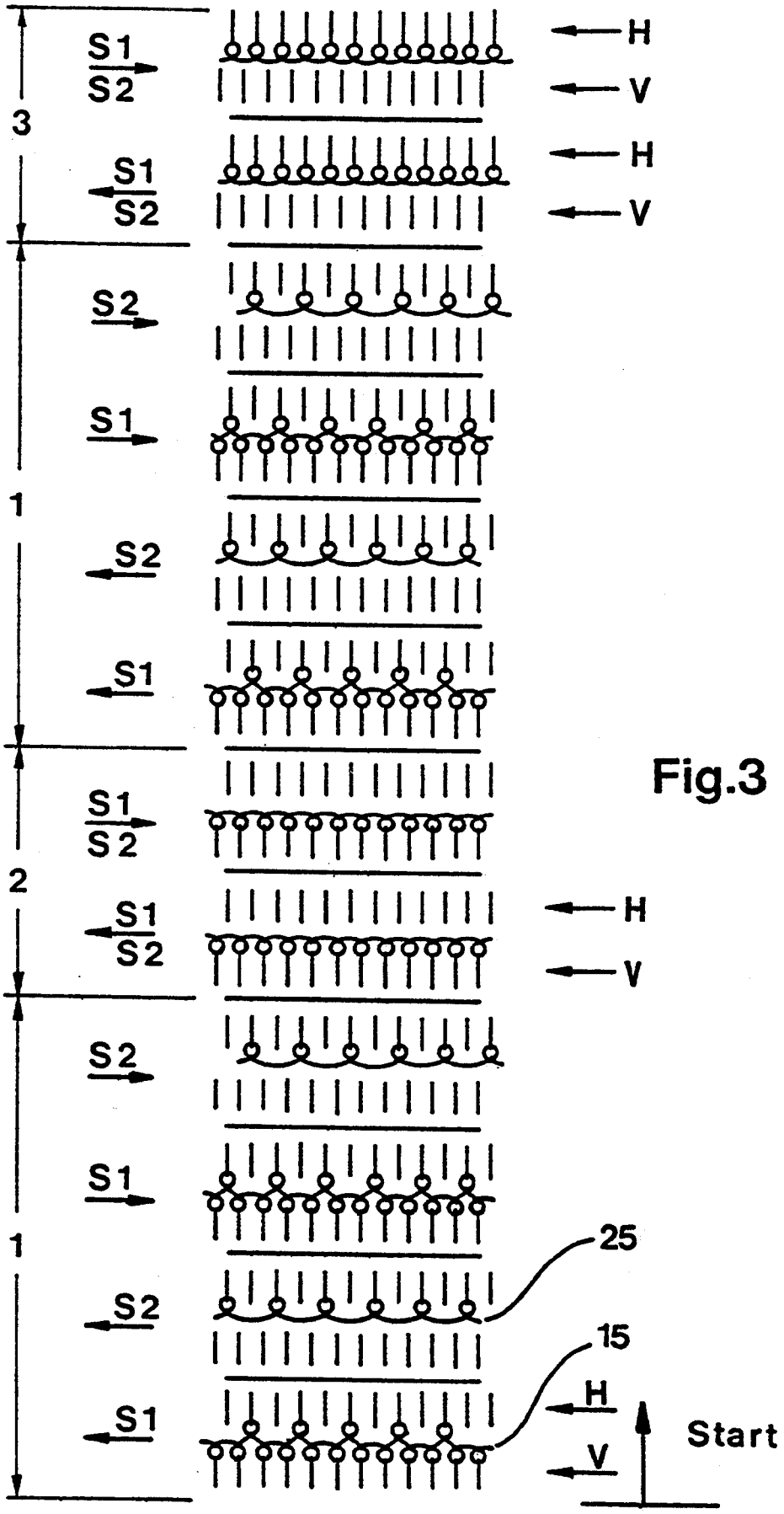
FIG. 3 is a view showing a course of a thread through the four knitting regions shown in FIG. 2 during knitting without fixed stitch wale formation.
Figure 4:
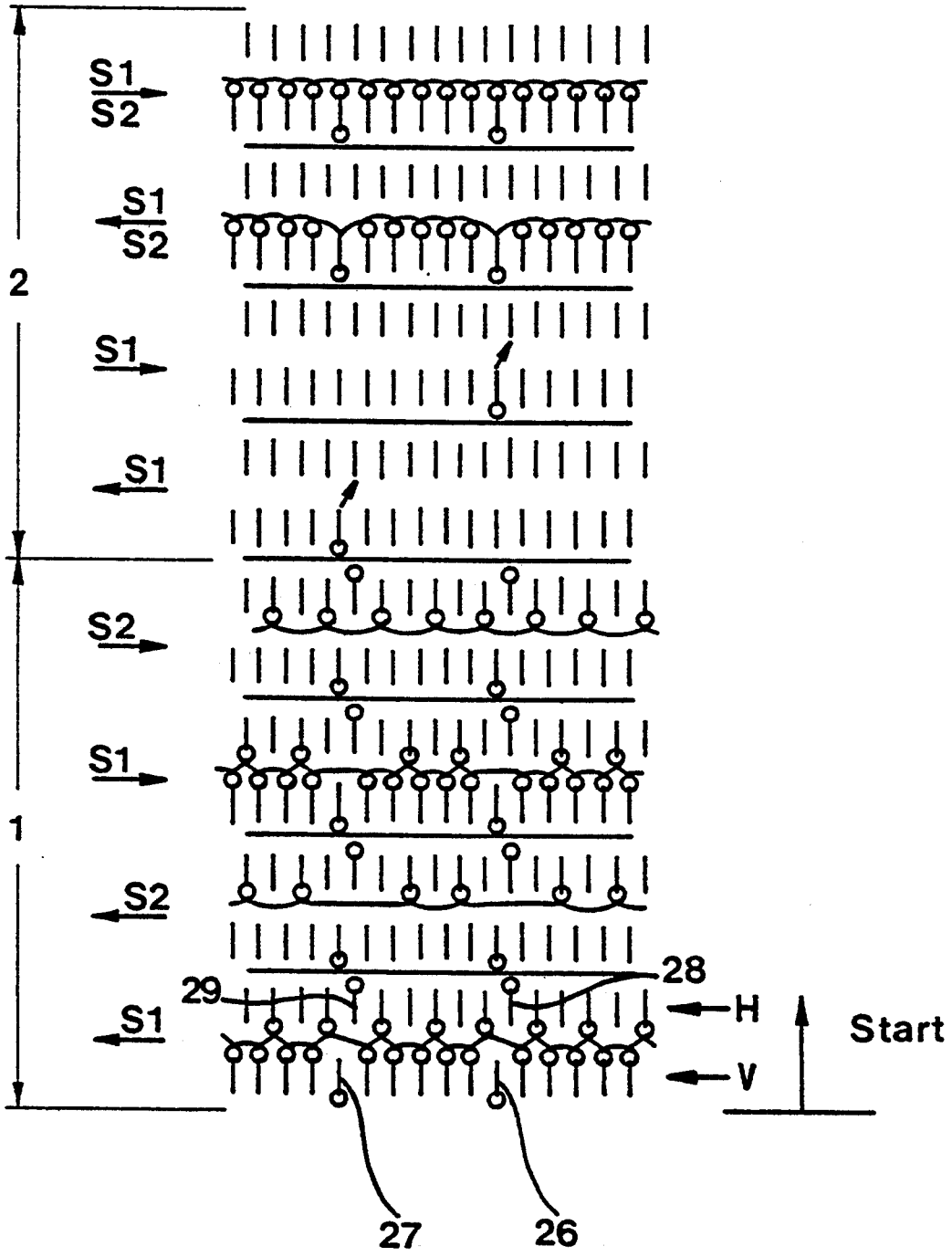
FIGS. 4 and 5 are a thread course illustration corresponding to FIG. 3 and distributed into two Figures, during the production of the knitted article with fixed stitch wales.
Figure 5:
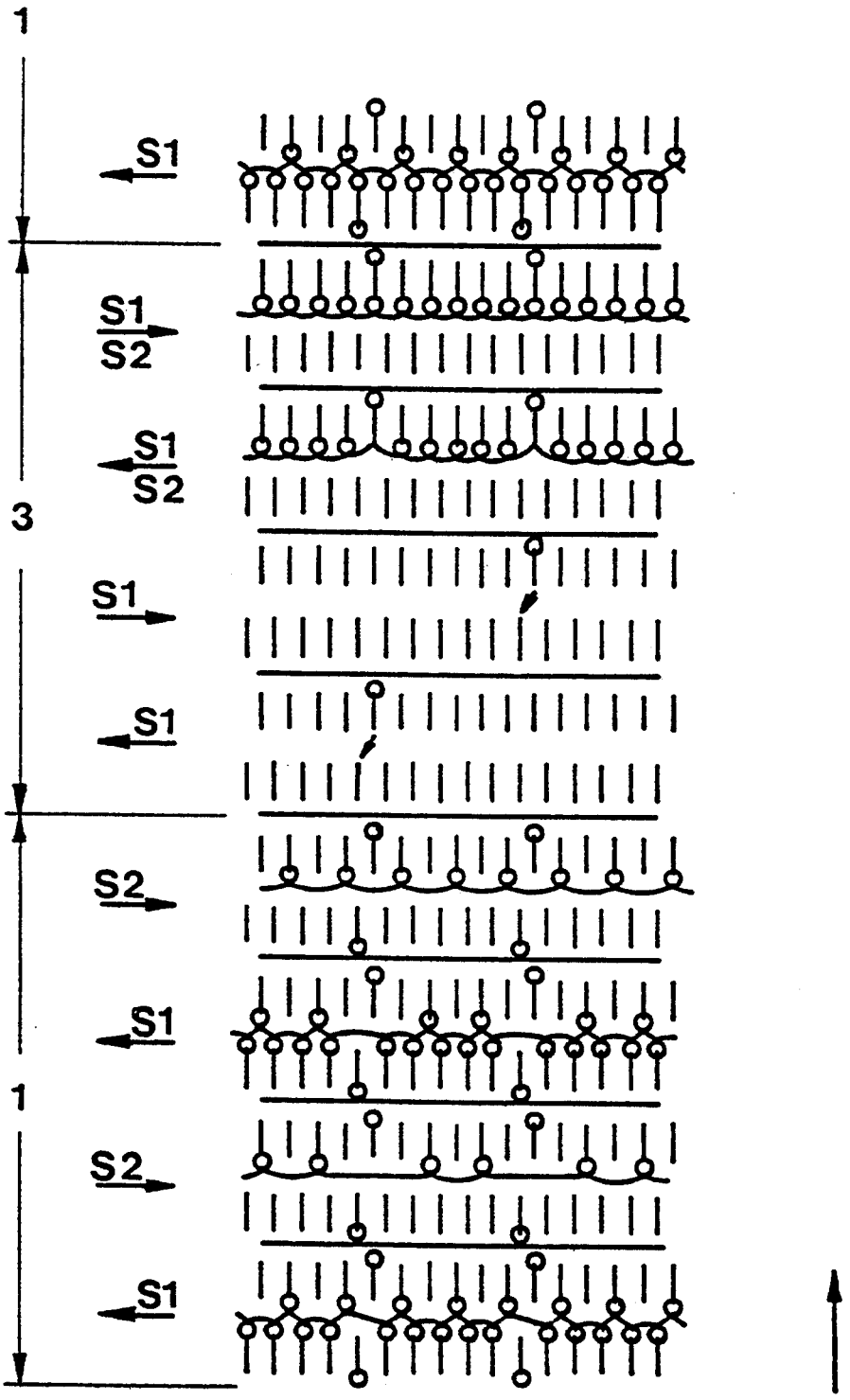

The type of the wale formation can be seen from the thread running illustrations in FIGS. 3–5. FIG. 3 shows a thread course in the successive knitting regions 1, 2, 1, 3 during the formation of a voluminous knitted article in accordance with FIG. 2, but without the worked-in stitch wales for fixing the knitted article. It is produced with a two-bed flat knitting machine, in which during each carriage travel two cams S1 and S2 can be used. During the carriage travel of the flat knitting machine in the first direction which is to the left in FIG. 3, a rib wale is knitted by the first cam S1 from a first thread 15 when each needle of the front needle bed V identified with a prime and with each second needle of the rear needle bed H. Simultaneously, a jersey wale is knitted over the base knitting width Bgrund shown in FIG. 3 with the second cam S2 with a second thread 25 with each releasing needle of the rear needle bed H. During the subsequent carriage travel in another direction which is to the right in FIG. 3, both cams S1 and S2 provide knitting in the same manner but only over a length which corresponds to the base knitting width Bgrund minus an offset width Bv. During the next carriage travel to the left, again the knitting is performed over the whole base knitting width Bgrund, so that a step-shaped offset curve provided in the knitting region 1 in FIG. 1 is obtained.

In the knitting region 2 the knitting jersey wales are knitted in correspondence with FIG. 2 over the maximum knitting width Bmax after one another in both carriage travel directions of FIG. 3 with all needles of the front needle bed. Then follows again a knitting region 1 with already described knitting sequence and with continuous offset of the needle beds. In the subsequent knitting region 3 which is shown above in FIGS. 2 and 3, again jersey wales are produced in both carriage travel directions and with both cams S1 and S2, but now with all needles of the rear needle bed.

From FIGS. 4 and 5 it can be seen how during the knitting process the stabilizing wales 13 shown in FIG. 1 are produced. In the beginning of the knitting process two needles 26 and 27 of the front needle bed V as well as two neighboring needles 28 and 29 of the rear needle bed H perform knitting of the wales. These needles are then temporarily uncoupled from the knitting process with the rows held by them, as shown in the knitting region 1 of FIGS. 4 and 5. In the knitting region 2 wrapping of wales formed by the selected needles 26–29 on a needle of the other needle bed, and then these wales are bound into the knitted article. Thereby, quilting-seam-like acting wales are formed in the longitudinal direction of the knitted article.

It will be understood that each of the elements described above, or two or more together, may also find a useful application in other types of constructions differing from the types described above.

While the invention has been illustrated and described as embodied in a method of producing voluminous knitted articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing voluminous knitted articles on a two-bed flat knitting machine, comprising the steps of forming by knitting a plurality of pocket-shaped convexities from a base plane over a length of a knitted article continuously and one after the other, and including a) knitting a rib wale row during a carriage travel in a first direction from a right edge of a maximal knitting width by a first cam from a first thread with each needle of a first needle bed and with each second needle of a second needle bed, and simultaneously knitting a jersey wale from a second thread with each first releasing needle of the second needle bed by a second cam over the base knitting width which is smaller than the maximal knitting width;

b) performing a carriage travel in a second direction and during the carriage travel repeating the step a) however over the base knitting width minus an offset width.

2. A method as defined in claim 1, wherein said knitting of pocket-shaped convexities includes knitting starting from a first edge of a maximal knitting width of a knitting article over a smaller base knitting width and offsetting the base knitting width from one wale to another wale to one side until a second edge of the maximal knitting width is reached, and then performing knitting with a corresponding offset in another direction until the first edge the maximal knitting width is reached.

3. A method as defined in claim 1, wherein said knitting further includes c) repeating the steps a) and b) until obtaining a left edge of the maximal knitting width;

d) repeating the steps a) and b) with a difference that the knitting is performed in the first direction of the carriage travel over the base knitting width minus the offset width and in the second direction of the carriage travel knitting over the base width;

e) after reaching again the right edge of the maximal knitting width, knitting in the first direction of the carriage travel a jersey wale with the needles of the first needle bed and with each of both cams correspondingly over the maximal knitting width;

f) in the second direction of the carriage travel repeating the step e);

g) repeating the steps a)–d);

h) after reaching again the right edge of the maximal knitting width repeating the steps e) and f) however with the needles of the second needle bed; and i) proceeding with the knitting with repeating the steps a)–h).

4. A method as defined in claim 3; and further comprising forming at least one quilt seam in a longitudinal direction of the knitting article.

5. A method as defined in claim 4, wherein said forming at least one quilt seam includes uncoupling at least one needle of the first needle bed which holds a wale and a neighboring needle of the second needle bed over the method steps a)–c); and surrounding the wales of the preceding uncoupled needles on a corresponding needle of another of the needle beds and coordinating the knitting over the step d).

* * * * *